United States Patent [19]

Wiczer

[11] Patent Number: 4,615,525

[45] Date of Patent: Oct. 7, 1986

[54] SPINNING TARGET ASSEMBLY

[75] Inventor: Max Wiczer, Skokie, Ill.

[73] Assignee: Wico Corporation, Niles, Ill.

[21] Appl. No.: 604,511

[22] Filed: Apr. 27, 1984

[51] Int. Cl.[4] ..... A63B 67/14

[52] U.S. Cl. ..... 273/127 D

[58] Field of Search ..... 273/127 D, 127 B, 127 R, 273/127 C, 181 R, 181 J, 177 A; 200/61.1, 61.11

[56] References Cited

U.S. PATENT DOCUMENTS

| | | | |
|---|---|---|---|
| 1,663,889 | 3/1928 | Rolfe | 273/177 A |
| 2,224,730 | 12/1940 | Hess | 273/127 R |
| 2,328,667 | 9/1943 | Nicholaus | 200/61.11 |
| 2,737,392 | 3/1956 | Stokes | 273/177 A |
| 3,826,883 | 7/1974 | Foster | 273/127 R |
| 4,097,047 | 6/1978 | Ochi | 273/127 R |
| 4,322,082 | 3/1982 | Peters | 273/127 D |

*Primary Examiner*—William H. Grieb
*Assistant Examiner*—T. Brown
*Attorney, Agent, or Firm*—Emrich & Dithmar

[57] ABSTRACT

The spinning target assembly comprises a post rotatably mounted to the playfield board of a pinball game. A bridge extends over and is substantially parallel to the playfield board. Three spinning target units hang downwardly from the bridge. The bridge and the units carried thereby are rotatable about the axis of the post to any selected position. Each unit includes a pair of supports and a target therebetween and rotatably carried thereby. A switch is associated with each unit and is located in the bridge to sense the number of revolutions of the target.

8 Claims, 5 Drawing Figures

SPINNING TARGET ASSEMBLY

BACKGROUND OF THE INVENTION

In a pinball game, a ball is propelled onto a playfield board which carries various targets. Points are awarded when these targets are struck by a ball. A spinning target assembly includes two posts and a platelike member rotatably mounted therebetween. When a ball strikes the member, it is caused to spin as the ball passes between the posts. Such a spinning target assembly is disclosed in U.S. Pat. No. 4,322,082 which is assigned to the assignee of the present application.

The posts of prior art spinning target assemblies are fixed in place on the playfield board. It would add excitement in playing the pinball game to move the entire spinning target from time to time or continuously. But, that is not possible with prior art assemblies which are attached to the playfield board.

SUMMARY OF THE INVENTION

It is, therefore, an important object of the present invention to provide a spinning target assembly in which the spinning target is not at a fixed location on the playfield board, but rather moves from time to time or continuously.

Another object is to suspend the spinning target above the playfield board.

In summary, there is provided a spinning target assembly for a pinball game having a playfield board on which a pinball rolls, comprising at least one upstanding post on the playfield board, a bridge carried by the post and positioned above the playfield board, and at least one spinning target unit hanging downwardly from the bridge.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
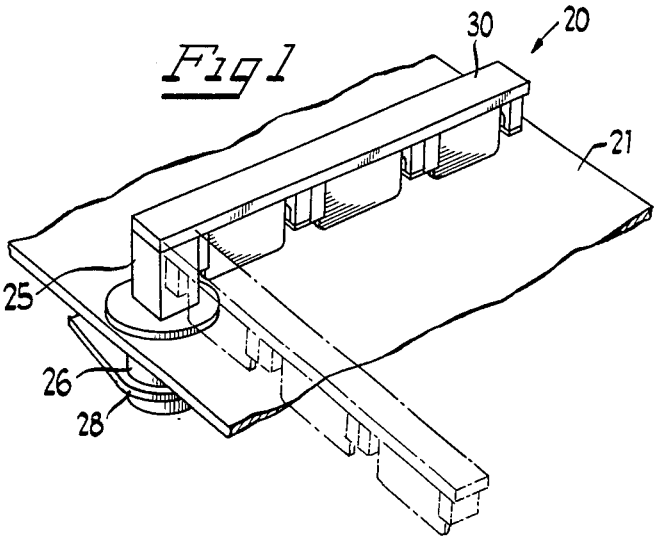
FIG. 1 is a fragmentary view of the top surface of a playfield board which carries a spinning target assembly incorporating the features of the present invention.

Turning now to the drawings and more particularly to FIG. 1 thereof, there is illustrated a spinning target assembly, generally designated by the numeral 20, constructed in accordance with and embodying the features of the present invention and adapted to be mounted on a playfield board 21 of a pinball game. In use, a pinball (not shown) rolls along the top surface of the playfield board 21 in a well-known manner.

The spinning target assembly 20 comprises a post 25 which is attached to a trunion 26 rotatably located in an opening in the playfield board 21. The trunion 26 is kept in place by means of a clip 27. A member 28 is attached to the trunion 26 and is coupled to driving means (not shown) which can rotate the trunion 26 about its vertical axis. The post 25 protrudes upwardly above the playfield board 21 and carries a bridge 30 that extends above and is substantially parallel to the playfield board 21.

Figure 5:
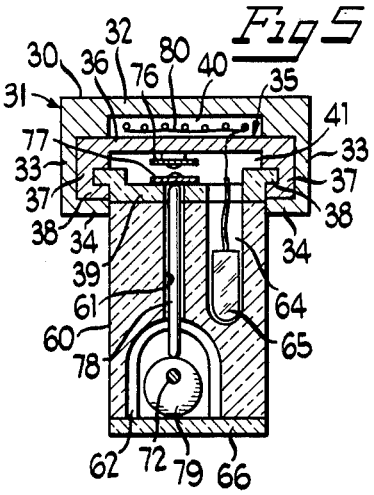
FIG. 5 is a view in vertical section taken along the line 5—5 of FIG. 4.

In the embodiment shown, and referring specifically to FIG. 5, the bridge 30 includes an elongated outer member 31 defined by a top wall 32 extending generally parallel to the playfield board 21, a pair of depending side walls 33 and a pair of inwardly directed lips 34. Within the outer member 31 is an inner member 35 which also has a top wall 36 disposed generally parallel to the playfield board 21, a pair of depending side walls 37, and a pair of inwardly directed lips 38. The inner member 35 is nestled in the outer member 31 so that the side walls 33 and 37 are in juxtaposition as are the lips 34 and 38. The bridge 30 also comprises a support strip 39 extending the length thereof and being located on the lip 38. A channel 40 is defined by the space between the top walls 32 and 36. A second channel 41 is defined by the space between the top wall 36 and the support strip 39.

Figure 2:
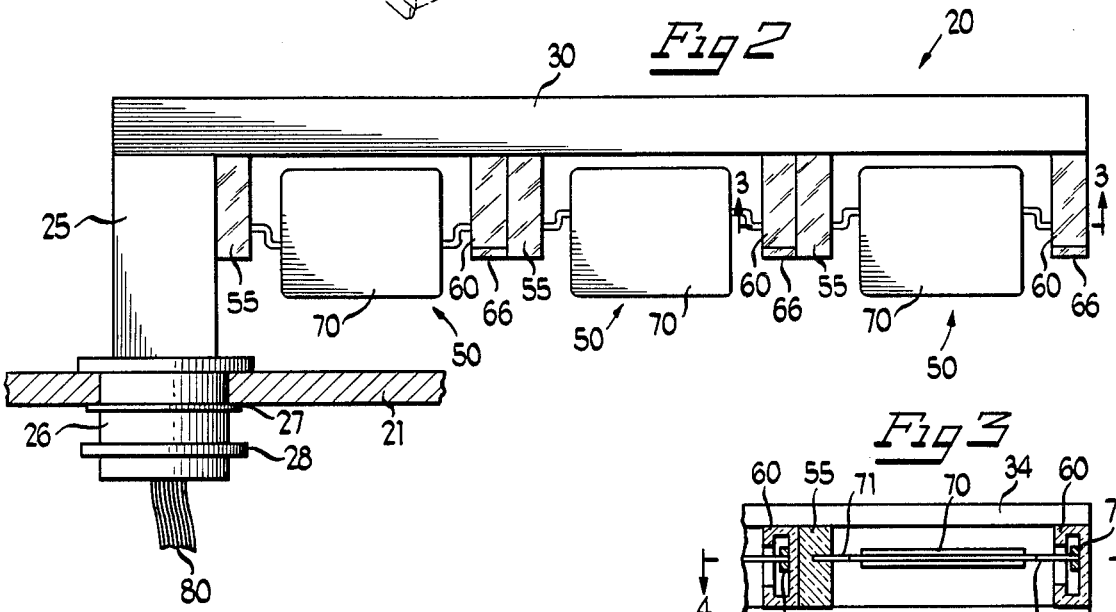
FIG. 2 is an elevational view of the spinning target assembly of FIG. 1 on an enlarged scale, the playfield board being shown in cross section.
Figure 3:
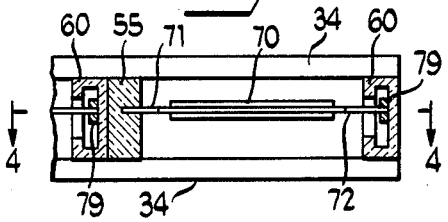
FIG. 3 is a view in horizontal section taken along the line 3—3 of FIG. 2.
Figure 4:
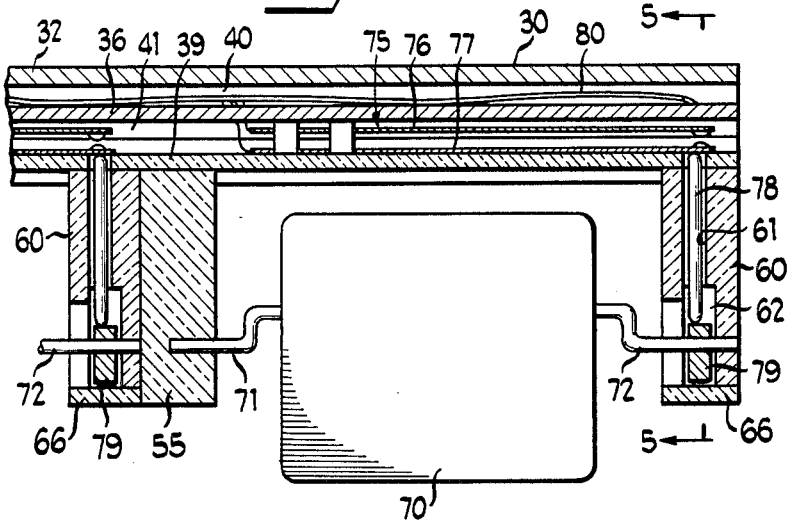
FIG. 4 is a view in vertical section taken along the line 4—4 of FIG. 3 on an enlarged scale.

The spinning target assembly 20 comprises a plurality of substantially identical units 50, as is best seen in FIG. 2. Each unit 50 includes a pair of spaced-apart supports 55 and 60 affixed to and depending from the support strip 39. Each of the supports 55 and 60 is generally in the shape of a rectangular block. Referring to FIGS. 4 and 5, the support 60 includes a longitudinally extending bore 61 terminating at its free end in a cavity 62. The support 60 also has an elongated recess 64 within which is located a bulb 65. A cap 66 is attached to the outer end of the support 60 to close the cavity 62. Preferably the supports 60 are transparent or translucent plastic so that the bulbs 65 can illuminate them.

Each unit 50 includes a target 70 which is generally platelike. The target 70 has crankshaft pins 71 and 72 extending laterally from the sides thereof. The pin 71 is journaled into an opening in the support 55 and the pin 72 is journaled into an opening in the support 60.

The spinning target assembly 20 further comprises a switch 75 associated with each of the units 50, the switches 75 being located within the channel 41 and being suitably secured to the inner member 35. Each switch includes a pair of leaves 76 and 77, the leaf 76 being generally fixed and the leaf 77 being generally movable. To move the leaf 77, there is provided a pin 78 in the bore 61 and slidable therein. A cam 79 is located in the cavity 62 and is attached to the pin 72. Thus, when the target 70 is rotated, the cam 79 is caused to rotate and move the pin 78 up and down. Such movement moves the leaf 77 up and down and into and out of contact with the fixed leaf 76. Within the channel 40 is a cable 80 having wires that are connected to the leaves 76 and 77 and other wires connected to the bulb 65. Such cable 80 is connected to an electronic circuit which responds to the opening and closing of the switches 75 to award scores and to turn on and off the bulbs 65. Such electronic circuitry can count the number of times the associated switch 75 is closed and, if desired, the score can reflect the number of revolutions. The electronic circuitry to which the cable 80 is connected illuminates the bulbs 65 as a result of various factors such as score. For example, the support 60 of any one of the units 50 may be illuminated, signifying that striking the corresponding target 70 at that instant would yield a greater score.

As previously stated, the bridge 30 can be rotated or pivoted to any selected position such as those represented by solid lines and phantom lines in FIG. 1. One way in which the spinning target assembly 20 may be utilized is to place it in the solid line position of FIG. 1 when the player has a certain score whereupon the individual units 50 may be struck by a ball. Other times during the game, the bridge 30 can be moved to an out-of-the-way position so that scores cannot be registered by striking the targets 70.

Accordingly, there has been described a spinning target assembly which has units that hang from a bridge. The units are not fixed in place on the playfield board, but rather move. Although a specific embodiment has been shown and described, it is to be understood that various changes can be made and still come within the scope of the following claims.

I claim:

1. A spinning target assembly for a pinball game having a playfield board in which a pinball moves and strikes said target, comprising an upstanding post on the playfield board, a bridge supported solely by said post and positioned above said playfield board, and at least one spinning target unit hanging downwardly from said bridge, said spinning target unit including support means depending from said bridge, and a target member mounted on said support means for complete rotation about an axis disposed generally parallel to the playfield board.

2. The spinning target assembly of claim 1, comprising a plurality of spinning target units hanging downwardly from said bridge.

3. The spinning target assembly of claim 1, wherein said support means includes a pair of supports depending from said bridge, said target member being disposed between said supports and rotatably mounted thereto.

4. The spinning target assembly of claim 3, wherein each of said supports is translucent or transparent and includes illumination means therein.

5. The spinning target assembly of claim 1, and further comprising means for providing electrical signals representative of the number of revolutions of said target member.

6. The spinning target assembly of claim 1, and further comprising a leaf spring switch associated with said spinning target unit and having a relatively fixed leaf and a relatively movable leaf, and means operated by said target member to move said second leaf into contact with said first leaf during each revolution of said target member.

7. The spinning target assembly of claim 1, wherein said bridge is supported adjacent to one end thereof so as to be cantilevered from said post.

8. A spinning target assembly for a pinball game having a playfield board on which a pinball moves, comprising at least one upstanding post on the playfield board having a longitudinal axis substantially perpendicular to the playfield board, a bridge carried by said post and positioned above said playfield board, driving means for rotating said post about the longitudinal axis thereof to pivot said bridge, and at least one spinning target unit hanging downwardly from said bridge, for being hit by a pinball rolling on the playfield board.

* * * * *